US012546553B2

(12) United States Patent
Keng

(10) Patent No.: US 12,546,553 B2
(45) Date of Patent: Feb. 10, 2026

(54) FIREARM MAGAZINE SHOOTING REST WITH A TOOL STORAGE RECEPTACLE

(71) Applicant: Multitasker Tools LLC, Atlanta, GA (US)

(72) Inventor: Shane Keng, Marietta, GA (US)

(73) Assignee: MULTITASKER TOOLS, LLC, Atlanta, GA (US)

( * ) Notice: Subject to any disclaimer, the term of this patent is extended or adjusted under 35 U.S.C. 154(b) by 106 days.

(21) Appl. No.: 18/489,239

(22) Filed: Oct. 18, 2023

(65) Prior Publication Data

US 2024/0183633 A1 Jun. 6, 2024

Related U.S. Application Data

(60) Provisional application No. 63/380,133, filed on Oct. 19, 2022.

(51) Int. Cl.
*F41A 9/65* (2006.01)
*F41A 23/16* (2006.01)

(52) U.S. Cl.
CPC ..... *F41A 23/16* (2013.01); *F41A 9/65* (2013.01)

(58) Field of Classification Search
CPC .. F41A 9/65; F41A 23/04; F41C 23/16; F41C 23/22
See application file for complete search history.

(56) References Cited

U.S. PATENT DOCUMENTS 1,222,458 A 4/1917 Peterson
4,026,055 A 5/1977 Weast
4,100,694 A * 7/1978 Musgrave ..... F41A 17/38 42/106
4,127,954 A 12/1978 Hausmann
4,390,927 A 6/1983 Von Feldt
4,393,614 A 7/1983 Pickett
4,414,769 A 11/1983 Mueschke
4,520,585 A 6/1985 Barrett
4,790,094 A 12/1988 Chestnut
4,862,620 A 9/1989 Chestnut
5,144,546 A 9/1992 Burdi
5,168,629 A 12/1992 Willard
D344,780 S 3/1994 Jenkins
5,377,437 A 1/1995 Underwood
5,573,329 A 11/1996 van Gennep
5,628,555 A 5/1997 Sharrah et al.
5,642,582 A 7/1997 Grams
5,666,752 A 9/1997 Grams
(Continued)

*Primary Examiner* — Michael D David
(74) *Attorney, Agent, or Firm* — EVERSHEDS SUTHERLAND (US) LLP

(57) ABSTRACT

A shooting rest for a firearm magazine may include a body having a front end and a rear end, with the body including a floor having a top side and a bottom side disposed opposite one another, a plurality of legs extending from the bottom side of the floor and configured for supporting the shooting rest on a surface, a plurality of walls extending from the top side of the floor and defining a magazine receptacle configured for removably receiving a bottom portion of the firearm magazine therein, a tool receptacle disposed on one of the plurality of walls and configured for removably receiving at least a portion of a tool therein, and a pliable arm disposed adjacent to the tool receptacle and configured for releasably retaining the at least a portion of the tool within the tool receptacle.

16 Claims, 6 Drawing Sheets

(56) References Cited

U.S. PATENT DOCUMENTS 5,725,096 A 3/1998 Winnard
5,768,819 A 6/1998 Neal
5,802,936 A 9/1998 Liu
D406,508 S 3/1999 Rivera
5,921,654 A 7/1999 Coyle
6,269,577 B1 8/2001 Hardy
6,279,186 B1 8/2001 Ge et al.
6,370,806 B1 4/2002 Klebes
6,481,136 B1 11/2002 Fitzpatrick
6,557,287 B2 5/2003 Wollmann
6,622,328 B2 9/2003 Rivera
6,668,479 B1 12/2003 Obong
6,698,127 B2 3/2004 Weber
6,751,819 B2 6/2004 Chuang
6,862,764 B2 3/2005 Ping
6,908,216 B2 6/2005 Love
6,948,409 B2 9/2005 Ackeret et al.
7,008,077 B2 3/2006 Raichlen
7,117,622 B2 10/2006 Freed
7,124,528 B2 10/2006 Long
7,146,668 B2 12/2006 Rivera
7,197,844 B2 4/2007 Benson
7,243,454 B1 7/2007 Cahill
7,278,764 B2 10/2007 Kim
7,281,397 B2 10/2007 Victor
7,478,496 B2 1/2009 Bender
D593,634 S 6/2009 Fitzpatrick
7,637,049 B1 12/2009 Samson et al.
7,669,357 B2 3/2010 Moody et al.
7,712,399 B2 5/2010 Nenadic
7,743,542 B1 6/2010 Novak
D642,647 S 8/2011 Fitzpatrick et al.
7,997,170 B1 8/2011 Martinez et al.
8,087,115 B2 1/2012 Barber et al.
8,127,480 B1 3/2012 McManus
8,196,504 B2 6/2012 Keng
8,316,492 B2 11/2012 Barber et al.
D680,613 S 4/2013 Fitzpatrick et al.
8,418,390 B1 4/2013 Wright
8,590,202 B2 11/2013 Keng
8,590,203 B1 11/2013 McCarthy
8,650,791 B2 2/2014 Williams
D706,895 S 6/2014 Zayatz
8,898,949 B1 12/2014 Greenwood
8,904,694 B1 * 12/2014 Afuh, II ..... F41A 35/02 42/96
D725,218 S 3/2015 Losilevsky
9,097,480 B2 8/2015 Keng
9,228,797 B2 1/2016 Anderson et al.
9,234,722 B2 1/2016 Rice et al.
9,387,575 B2 7/2016 Wei
9,623,546 B2 4/2017 Keng
9,945,627 B2 4/2018 Porat
10,126,076 B2 11/2018 Klein et al.
10,161,705 B2 12/2018 Keng et al.
10,184,746 B1 1/2019 Liu
10,190,840 B1 1/2019 Renteria
10,247,520 B2 4/2019 Manly
10,401,114 B2 9/2019 Floyd
10,480,879 B2 * 11/2019 Harris ..... F41A 3/66
10,684,089 B2 6/2020 Keng
10,948,255 B2 3/2021 Keng
D989,907 S 6/2023 Ding et al.
2002/0029506 A1 3/2002 Wollmann
2003/0037474 A1 2/2003 Weber
2003/0155397 A1 * 8/2003 Neumann ..... B25C 1/186 227/10
2004/0141313 A1 7/2004 Elsener
2005/0011097 A1 1/2005 Freed
2005/0011104 A1 1/2005 Oz
2006/0164846 A1 7/2006 Kim
2006/0262518 A1 11/2006 Thuma et al.
2008/0190003 A1 8/2008 Bolen
2009/0000038 A1 1/2009 Padden
2009/0235569 A1 9/2009 Morando
2010/0043270 A1 2/2010 Mantas
2010/0154275 A1 6/2010 Faifer
2011/0173858 A1 7/2011 Troy
2011/0283582 A1 11/2011 Hunter et al.
2012/0073429 A1 3/2012 Bowles
2012/0085013 A1 4/2012 Cahill
2012/0137564 A1 6/2012 Swenson, III
2012/0167430 A1 7/2012 Freed
2012/0174452 A1 7/2012 Anderson
2012/0180360 A1 7/2012 Jones
2012/0198746 A1 8/2012 Keng
2012/0255979 A1 10/2012 Sitz
2013/0025071 A1 1/2013 Keng
2013/0086834 A1 4/2013 Battaglia
2013/0145672 A1 6/2013 Tuller, Jr.
2013/0227870 A1 9/2013 Rendulic
2013/0333261 A1 12/2013 Clifton, Jr. et al.
2014/0033592 A1 2/2014 Fiorucci
2014/0047751 A1 2/2014 Lee
2014/0047755 A1 2/2014 McClintock
2014/0068992 A1 3/2014 Keng
2014/0196349 A1 7/2014 Rogers
2014/0305019 A1 10/2014 King, Jr.
2014/0338245 A1 11/2014 Lanasa et al.
2015/0121736 A1 5/2015 Faifer
2015/0330740 A1 11/2015 Wei
2016/0069637 A1 3/2016 Kafer
2016/0097614 A1 4/2016 Manly
2016/0265872 A1 9/2016 Tarazi
2016/0363407 A1 12/2016 Hanington
2017/0160038 A1 6/2017 Keng et al.
2017/0254613 A1 9/2017 Kedairy
2019/0195591 A1 * 6/2019 Keng ..... F41C 27/22
2019/0226778 A1 7/2019 Cross
2019/0390936 A1 12/2019 Keng
2020/0284544 A1 * 9/2020 Keng ..... F41A 23/04
2020/0363171 A1 * 11/2020 Shipley ..... F42B 5/045
2021/0231402 A1 7/2021 Morris
2021/0310758 A1 * 10/2021 Kellgren ..... F41A 9/12
2022/0390203 A1 12/2022 Keng
2024/0183633 A1 * 6/2024 Keng ..... F41A 9/65

* cited by examiner

FIREARM MAGAZINE SHOOTING REST WITH A TOOL STORAGE RECEPTACLE

CROSS-REFERENCE TO RELATED APPLICATIONS

The present application claims the benefit of and priority to U.S. Provisional Application No. 63/380,133, filed on Oct. 19, 2022, the disclosure of which is incorporated by reference herein in its entirety.

FIELD OF THE DISCLOSURE

The present disclosure relates generally to shooting rest attachments for firearms and, more particularly, to a firearm magazine shooting rest with a tool storage receptacle and related methods of manufacturing and using the same.

BACKGROUND OF THE DISCLOSURE

Modem firearms may have various types of accessories mounted thereto, including modifications for different parts of a firearm, such as the barrel, the stock, the slide, or the sight. Example accessories include firearm-mounted lights, holographic red dot sights, and the like. In different instances, firearm accessories may be used to improve the accuracy of the firearm, modify the weight of the firearm, or allow the firearm to be taken apart more easily. Certain accessories often may require one or more tools to maintain proper function of the devices and/or to perform adjustments to point of aim. Conventional tools used to perform these tasks generally may be cumbersome, heavy, and/or simply inconvenient for a user to carry, keep track of, or access for subsequent use, when needed. Accordingly, such tools often may be kept in a storage container or a pocket of the user's clothing. As a result, when a tool for a firearm accessory is needed, the user may spend an undesirable amount of time locating and accessing the required tool, which may be particularly frustrating when the user seeks to quickly adjust or repair the accessory.

A need, therefore, exists for devices and methods for storing tools for firearm accessories, which may overcome one or more of the above-mentioned problems associated with existing storage devices and techniques.

SUMMARY OF THE DISCLOSURE

The present disclosure provides shooting rests for a firearm magazine and methods of manufacturing a shooting rest for a firearm magazine. As described herein, the shooting rests may include a tool storage receptacle for removably storing a tool, such as a firearm accessory tool.

In one aspect, a shooting rest for a firearm magazine is provided. According to one example, the shooting rest may include a body having a front end and a rear end disposed opposite one another. The body may include a floor, a plurality of legs, a plurality of walls, a tool receptacle, and a pliable arm. The floor may have a top side and a bottom side disposed opposite one another. The plurality of legs may extend from the bottom side of the floor and be configured for supporting the shooting rest on a surface. The plurality of walls may extend from the top side of the floor and define a magazine receptacle configured for removably receiving a bottom portion of the firearm magazine therein. The tool receptacle may be disposed on one of the plurality of walls and configured for removably receiving at least a portion of a tool therein. The pliable arm may be disposed adjacent to the tool receptacle and configured for releasably retaining the at least a portion of the tool within the tool receptacle.

In some examples, the plurality of walls may include a rear wall disposed at the rear end of the body, and the tool receptacle may be disposed on the rear wall. In some examples, the tool receptacle may be disposed on an outer surface of the rear wall opposite the magazine receptacle. In some examples, the plurality of walls also may include a first sidewall and a second sidewall spaced apart from one another and each extending from the rear wall. In some examples, the tool receptacle may include an open end configured for allowing the tool to be inserted into and removed from the tool receptacle and a closed end disposed opposite the open end and configured for limiting insertion of the tool into the tool receptacle beyond the closed end. In some examples, the tool receptacle also may include a first rail extending along a first side of the tool receptacle and a second rail extending along a second side of the tool receptacle and spaced apart from the first rail. The first rail may define a first channel configured for removably receiving a first side portion of the tool, and the second rail may define a second channel configured for removably receiving a second side portion of the tool. In some examples, the tool receptacle also may include a stop disposed between the first rail and the second rail and defining the closed end of the tool receptacle, and the stop may be shaped to complement one or more tool features of the tool.

In some examples, the pliable arm may be defined by a cutout extending through the one of the plurality of walls. In some examples, the pliable arm may be configured for being resiliently deflected from a first position, in which the pliable arm retains the at least a portion of the tool within the tool receptacle, to a second position, in which the pliable arm allows the at least a portion of the tool to be removed from the tool receptacle. In some examples, the pliable arm may include a protrusion configured for engaging an opening of the tool when the pliable arm is in the first position and the at least a portion of the tool is received within the tool receptacle and for disengaging the opening of the tool when the pliable arm is in the second position. In some examples, the protrusion may include a beveled edge configured such that the pliable arm is resiliently deflected from the first position toward the second position as the tool is inserted into the tool receptacle. In some examples, the protrusion may be configured for being accessible through the opening of the tool when the pliable arm is in the first position and the at least a portion of the tool is received within the tool receptacle.

In another aspect, a shooting rest for a firearm magazine is provided. According to one example, the shooting rest may include a tool and a body. The tool may have a first end and a second end disposed opposite one another, and the tool may include a plurality of tool features. The body may have a front end and a rear end disposed opposite one another, and the body may include a floor, a plurality of legs, a plurality of walls, a tool receptacle, and a pliable arm. The floor may have a top side and a bottom side disposed opposite one another. The plurality of legs may extend from the bottom side of the floor and be configured for supporting the shooting rest on a surface. The plurality of walls may extend from the top side of the floor and define a magazine receptacle configured for removably receiving a bottom portion of the firearm magazine therein. The tool receptacle may be disposed on one of the plurality of walls and configured for removably receiving at least a portion of a tool therein. The pliable arm may be disposed adjacent to the tool receptacle and configured for releasably retaining the at least a portion of the tool within the tool receptacle.

In some examples, the plurality of walls may include a rear wall disposed at the rear end of the body, and the tool receptacle may be disposed on the rear wall. In some examples, the tool receptacle may be disposed on an outer surface of the rear wall opposite the magazine receptacle. In some examples, the plurality of walls also may include a first sidewall and a second sidewall spaced apart from one another and each extending from the rear wall. In some examples, the tool receptacle may include an open end configured for allowing the tool to be inserted into and removed from the tool receptacle and a closed end disposed opposite the open end and configured for limiting insertion of the tool into the tool receptacle beyond the closed end. In some examples, the tool also may include a first side portion and a second side portion disposed opposite one another, and the tool receptacle also may include a first rail extending along a first side of the tool receptacle, and a second rail extending along a second side of the tool receptacle and spaced apart from the first rail. The first rail may define a first channel configured for removably receiving the first side portion of the tool, and the second rail may define a second channel configured for removably receiving the second side portion of the tool. In some examples, the tool receptacle also may include a stop disposed between the first rail and the second rail and defining the closed end of the tool receptacle, and the stop may be shaped to complement one or more of the tool features of the tool.

In some examples, the pliable arm may be defined by a cutout extending through the one of the plurality of walls. In some examples, the pliable arm may be configured for being resiliently deflected from a first position, in which the pliable arm retains the at least a portion of the tool within the tool receptacle, to a second position, in which the pliable arm allows the at least a portion of the tool to be removed from the tool receptacle. In some examples, the tool also may include an opening, and the pliable arm may include a protrusion configured for engaging the opening of the tool when the pliable arm is in the first position and the at least a portion of the tool is received within the tool receptacle and for disengaging the opening of the tool when the pliable arm is in the second position. In some examples, the protrusion may include a beveled edge configured such that the pliable arm is resiliently deflected from the first position toward the second position as the tool is inserted into the tool receptacle. In some examples, the protrusion may be configured for being accessible through the opening of the tool when the pliable arm is in the first position and the at least a portion of the tool is received within the tool receptacle.

In another aspect, a method of manufacturing a shooting rest for a firearm magazine is provided. The method may include providing a body having a front end and a rear end disposed opposite one another; providing a floor having a top side and a bottom side disposed opposite one another; providing a plurality of legs extending from the bottom side of the floor and configured for supporting the shooting rest on a surface; providing a plurality of walls extending from the top side of the floor and defining a magazine receptacle configured for removably receiving a bottom portion of the firearm magazine therein; providing a tool receptacle disposed on one of the plurality of walls and configured for removably receiving at least a portion of a tool therein; and providing a pliable arm disposed adjacent to the tool receptacle and configured for releasably retaining the at least a portion of the tool within the tool receptacle.

In some examples, the plurality of walls may include a rear wall disposed at the rear end of the body, and the tool receptacle may be disposed on the rear wall. In some examples, the tool receptacle may be disposed on an outer surface of the rear wall opposite the magazine receptacle. In some examples, the plurality of walls also may include a first sidewall and a second sidewall spaced apart from one another and each extending from the rear wall. In some examples, the tool receptacle may include an open end configured for allowing the tool to be inserted into and removed from the tool receptacle and a closed end disposed opposite the open end and configured for limiting insertion of the tool into the tool receptacle beyond the closed end. In some examples, the tool receptacle also may include a first rail extending along a first side of the tool receptacle and a second rail extending along a second side of the tool receptacle and spaced apart from the first rail. The first rail may define a first channel configured for removably receiving a first side portion of the tool, and the second rail may define a second channel configured for removably receiving a second side portion of the tool. In some examples, the tool receptacle also may include a stop disposed between the first rail and the second rail and defining the closed end of the tool receptacle, and the stop may be shaped to complement one or more tool features of the tool.

In some examples, the pliable arm may be defined by a cutout extending through the one of the plurality of walls. In some examples, the pliable arm may be configured for being resiliently deflected from a first position, in which the pliable arm retains the at least a portion of the tool within the tool receptacle, to a second position, in which the pliable arm allows the at least a portion of the tool to be removed from the tool receptacle. In some examples, the pliable arm may include a protrusion configured for engaging an opening of the tool when the pliable arm is in the first position and the at least a portion of the tool is received within the tool receptacle and for disengaging the opening of the tool when the pliable arm is in the second position. In some examples, the protrusion may include a beveled edge configured such that the pliable arm is resiliently deflected from the first position toward the second position as the tool is inserted into the tool receptacle. In some examples, the protrusion may be configured for being accessible through the opening of the tool when the pliable arm is in the first position and the at least a portion of the tool is received within the tool receptacle.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings, and some of the elements, components, and/or configurations illustrated in the drawings may not be present in certain examples.

DETAILED DESCRIPTION OF THE DISCLOSURE

Figure 1:
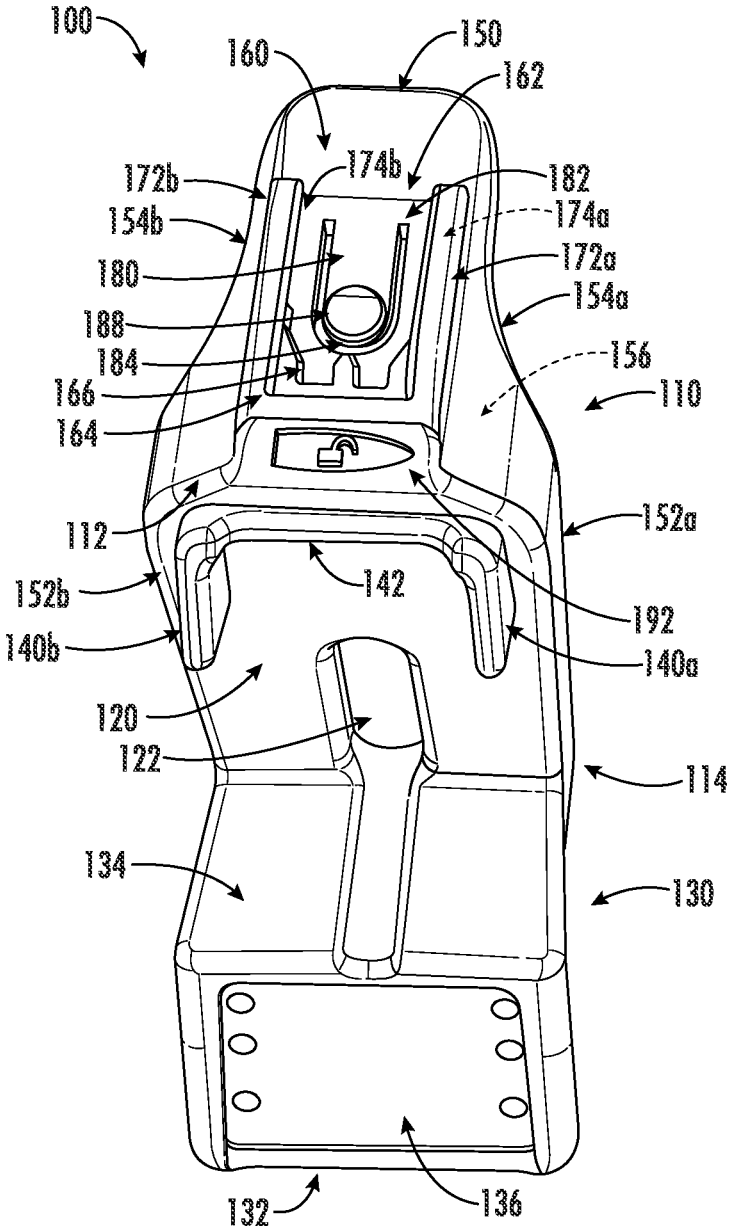
FIG. 1 is a rear perspective view of a shooting rest for a firearm magazine according to one or more examples of the disclosure.

In the following description, specific details are set forth, describing some examples consistent with the present disclosure. Numerous specific details are set forth in order to provide a thorough understanding of the examples. It will be apparent, however, to one skilled in the art that some examples may be practiced without some or all of these specific details. The specific examples disclosed herein are meant to be illustrative but not limiting. One skilled in the art may realize other examples that, although not specifically described here, are within the scope and the spirit of this disclosure. In addition, to avoid unnecessary repetition, one or more features shown and described in association with one example may be incorporated into other examples unless specifically described otherwise or if the one or more features would make an example non-functional. In some instances, well-known methods, procedures, and components have not been described in detail so as not to unnecessarily obscure aspects of the examples.

The present disclosure provides shooting rests for a firearm magazine and methods of manufacturing a shooting rest for a firearm magazine. As described herein, the shooting rests may be configured for coupling to a firearm magazine and may include a tool storage receptacle for removably storing a tool, such as a firearm accessory tool. As discussed above, various types of accessories, such as firearm-mounted lights, holographic red dot sights, and the like, may be used with modern firearms for numerous purposes. Certain accessories often may require one or more tools to maintain proper function of the devices and/or to perform adjustments to point of aim. Conventional tools used to perform these tasks generally may be cumbersome, heavy, and/or simply inconvenient for a user to carry, keep track of, or access for subsequent use, when needed. Accordingly, such tools often may be kept in a storage container or a pocket of the user's clothing. As a result, when a tool for a firearm accessory is needed, the user may spend an undesirable amount of time locating and accessing the required tool.

According to examples described herein, a shooting rest may include a body having a front end and a rear end disposed opposite one another. The body may include a floor, a plurality of legs, a plurality of walls, a tool receptacle, and a pliable arm. The floor may have a top side and a bottom side disposed opposite one another. The plurality of legs may extend from the bottom side of the floor and be configured for supporting the shooting rest on a surface. The plurality of walls may extend from the top side of the floor and define a magazine receptacle configured for removably receiving a bottom portion of the firearm magazine therein. The tool receptacle may be disposed on one of the plurality of walls and configured for removably receiving at least a portion of a tool therein. The pliable arm may be disposed adjacent to the tool receptacle and configured for releasably retaining the at least a portion of the tool within the tool receptacle. In this manner, the tool receptacle of the shooting rest may provide a convenient and lightweight storage space for a firearm accessory tool, with the shooting rest being coupled to the firearm magazine, allowing for quick access to the tool, when needed. By storing the tool on the shooting rest, a user may readily access the tool for adjustment or repair of an accessory, avoiding lost time associated with locating and accessing the tool according to conventional techniques. As described herein, the pliable arm of the shooting rest may securely retain the tool within the tool receptacle when the tool is not needed, including during operation of the firearm, yet the pliable arm may be quickly deflected by the user, when desired, to allow the tool to be removed from the tool receptacle for use.

Still other benefits and advantages of the gas blocks, gas assemblies, and methods provided herein over conventional devices and techniques will be appreciated by those of ordinary skill in the art from the present disclosure.

Example Shooting Rest

Figure 2:
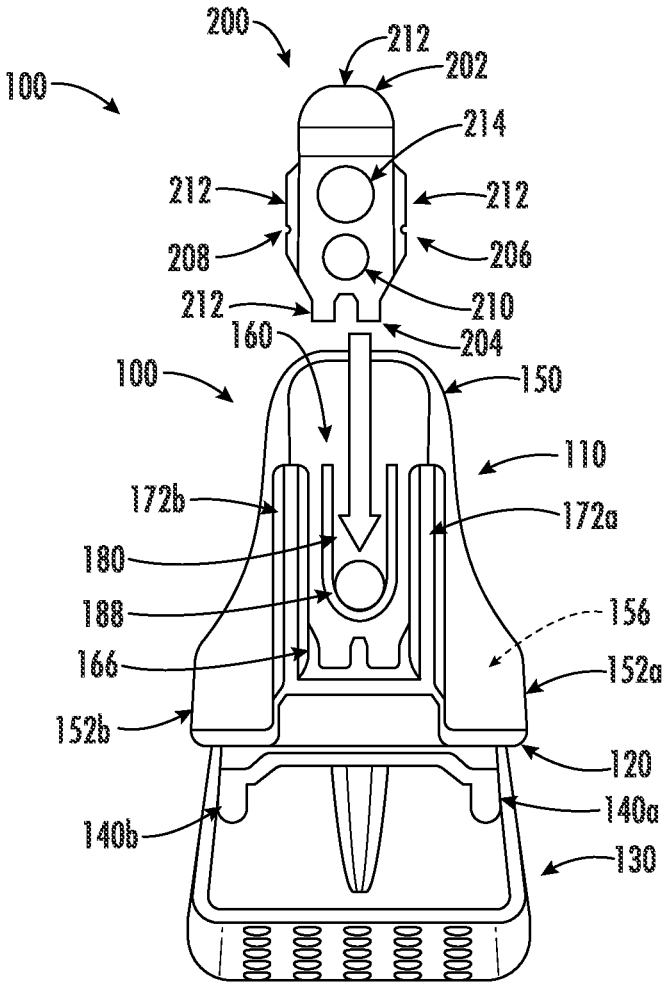
FIG. 2 is a rear view of the shooting rest of FIG. 1 and a tool for a firearm accessory according to one or more examples of the disclosure, showing the tool removed from a tool receptacle of the shooting rest and indicating how the tool may be inserted into the tool receptacle.
Figure 3:
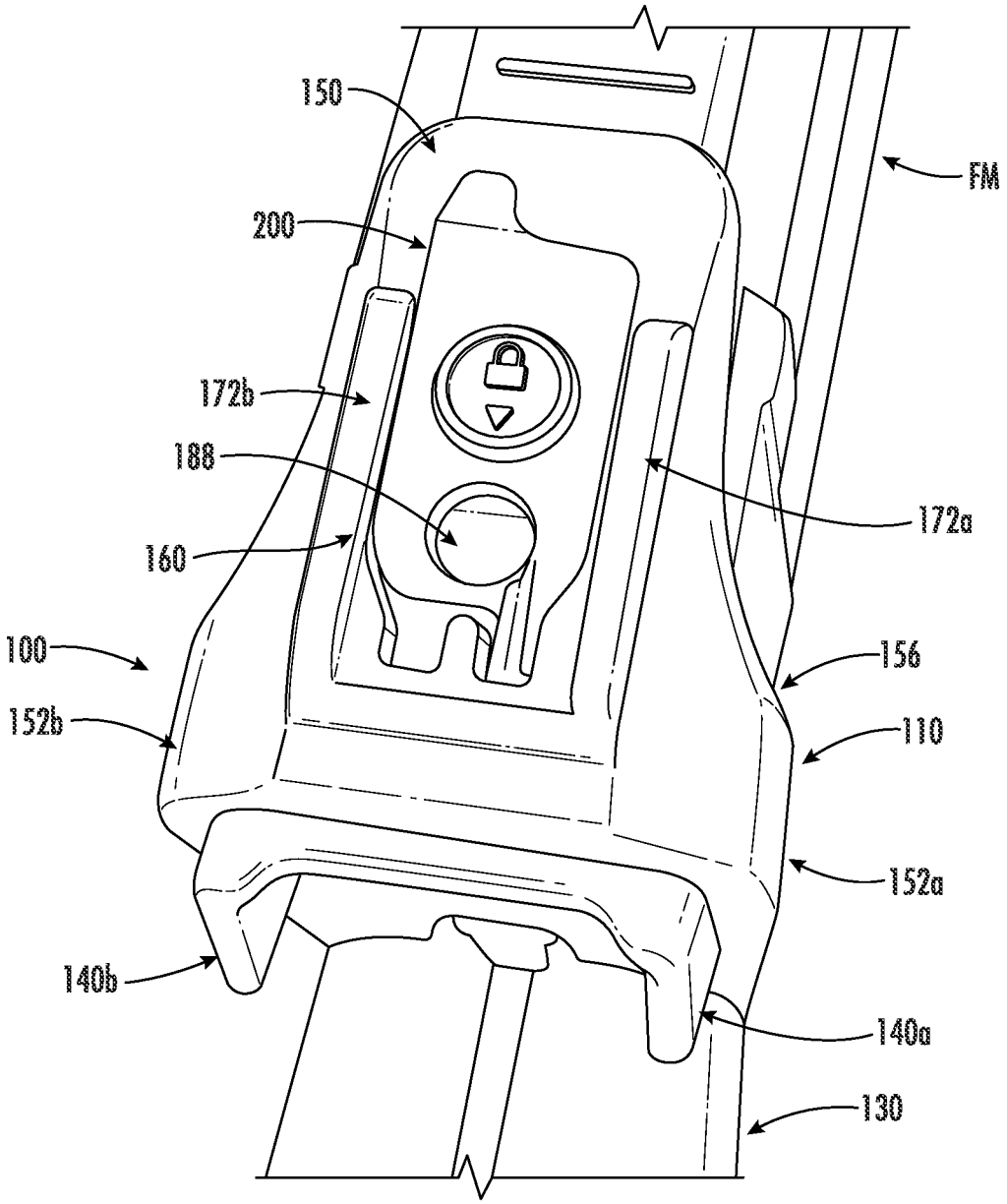
FIG. 3 is a rear perspective view of the shooting rest of FIG. 1, showing the tool received within the tool receptacle and retained therein by a pliable arm of the shooting rest.
Figure 4:
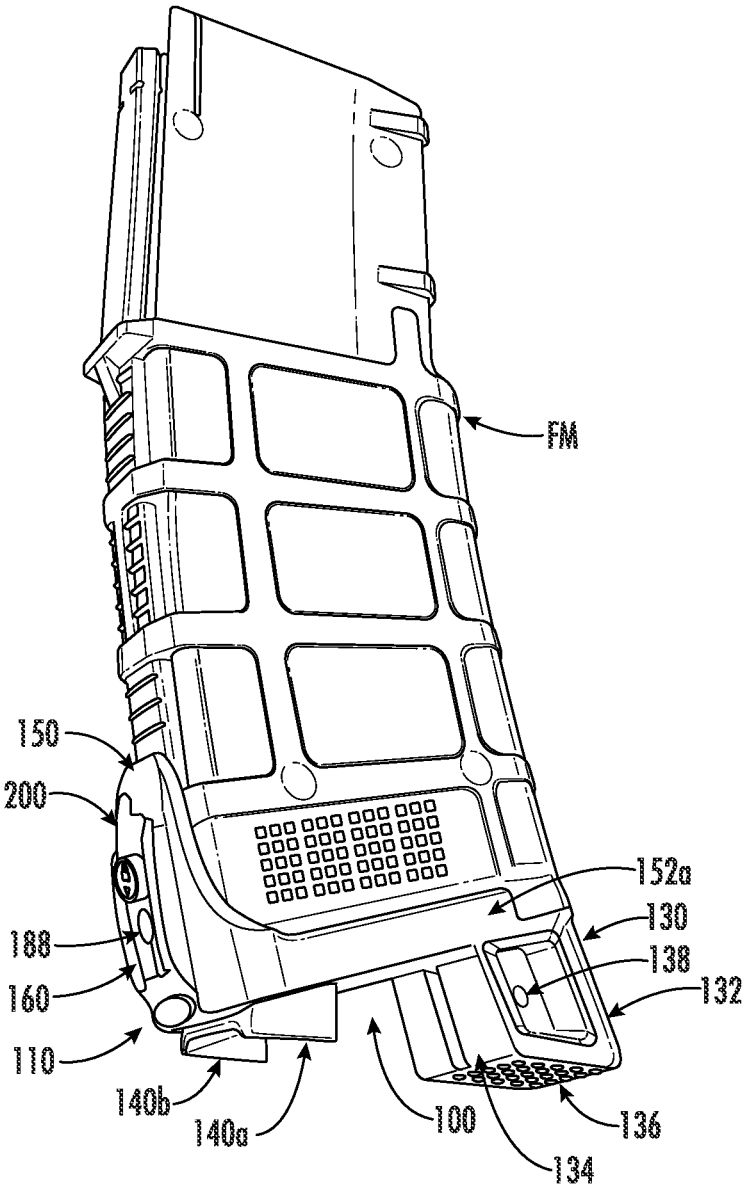
FIG. 4 is a side perspective view of the shooting rest of FIG. 1, showing the shooting rest coupled to an example firearm magazine and the tool received within the tool receptacle.
Figure 5:
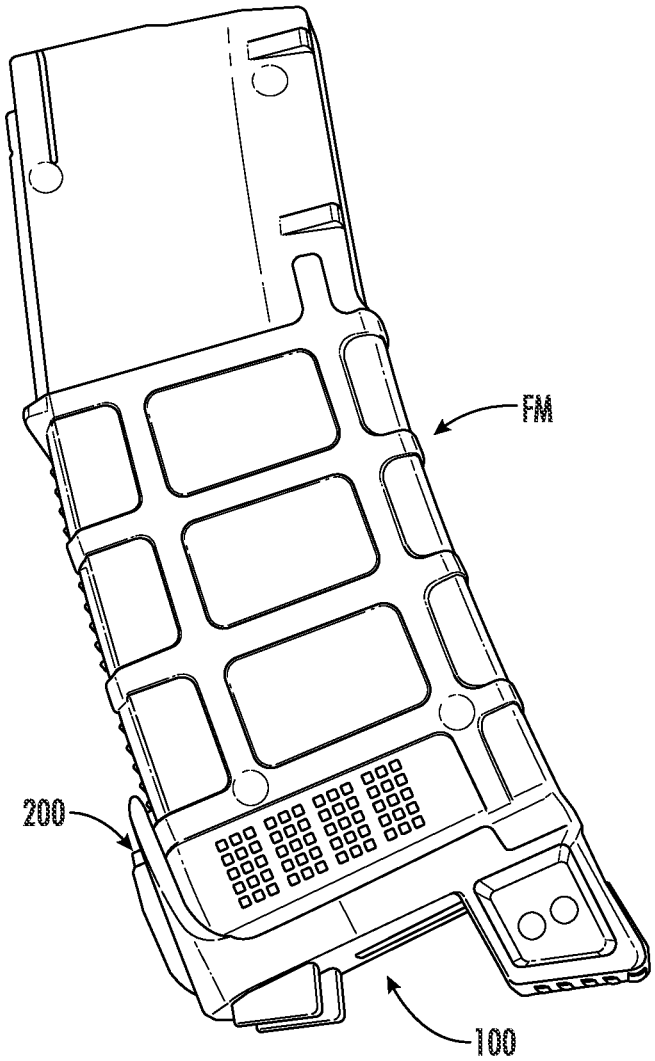
FIG. 5 is a side view of the shooting rest of FIG. 1, showing the shooting rest coupled to the firearm magazine and the tool received within the tool receptacle.
Figure 6:
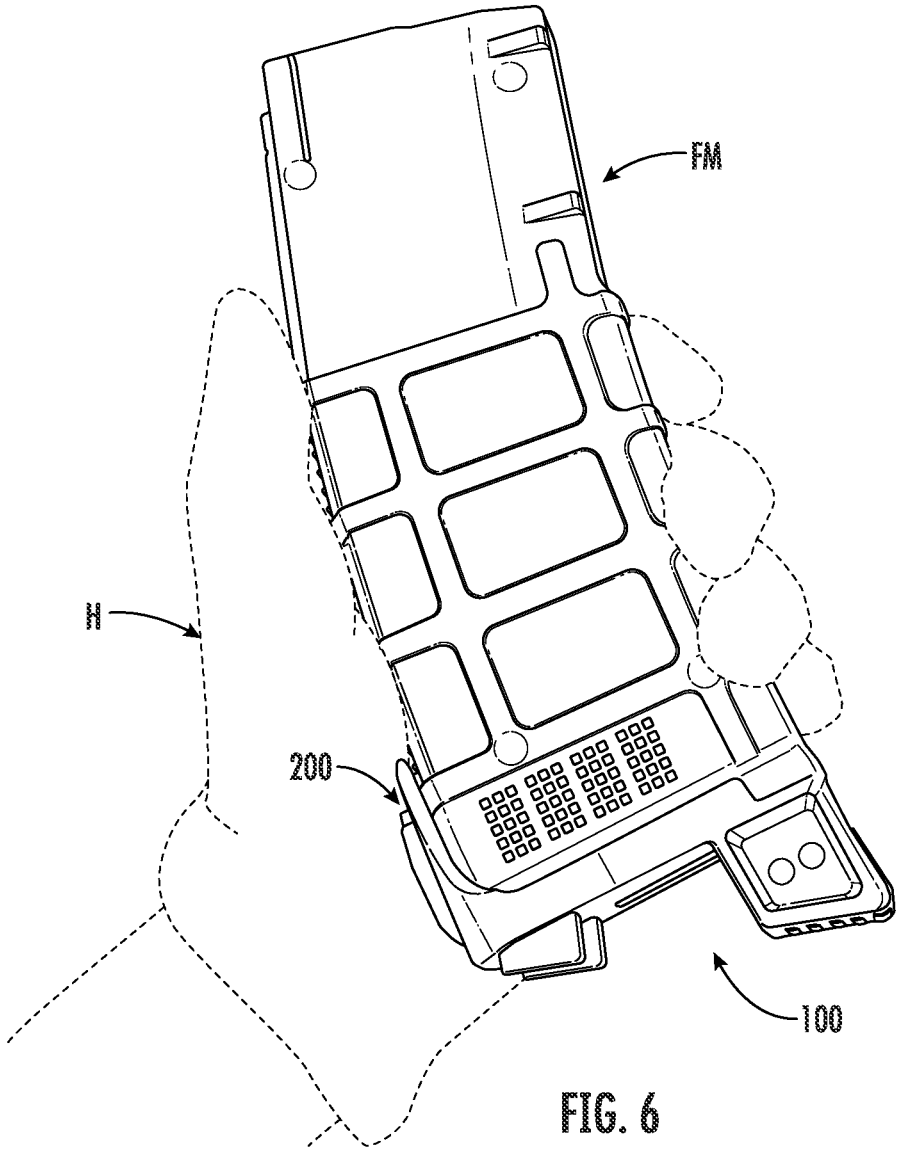
FIG. 6 is a side perspective view of the shooting rest of FIG. 1, showing the shooting rest coupled to the firearm magazine and the tool received within the tool receptacle, with a user's hand grasping the firearm magazine.

Referring now to the drawings, FIGS. 1-6 depict a shooting rest 100 for a firearm magazine according to one or more examples of the present disclosure. FIGS. 3-6 show the shooting rest 100 coupled to an example firearm magazine FM, although the shooting rest 100 may be used with various types of magazines configured for different firearms. In some instances, as shown, the shooting rest 100 may replace an existing baseplate of the firearm magazine FM. In other instances, the shooting rest 100 may be coupled to the firearm magazine FM, without removing the baseplate thereof. Various means of mechanical attachment, such as mating features, fasteners, adhesives, and the like, may be used for coupling the shooting rest 100 to the firearm magazine FM. When coupled to the firearm magazine FM, the shooting rest 100 may be used provide greater stability while positioning and aiming the firearm in which the firearm magazine FM is inserted. As described herein, the shooting rest 100 may be used for conveniently and removably storing a tool 200, which may be a tool configured for use with one or more firearm accessories. In this manner, the shooting rest 100 may provide a convenient and lightweight storage space for the tool 200, with the shooting rest 100 being coupled to the firearm magazine FM, allowing for quick access to the tool 200, when needed. Although the tool 200 is depicted in the drawings, it will be appreciated that the shooting rest 100 may be used with various different configurations of tools and may be specifically configured for storing one or more particular tools.

According to the illustrated examples, the tool 200 may be provided as an elongated, unitary component having a first end 202 and a second end 204 disposed opposite one another in a direction of a longitudinal axis of the tool 200. As shown, the tool 200 may be formed as a generally planar body having a generally planar front side and a generally planar backside, although other forms of the tool 200 may be used. Along opposite edges of the main body of the tool 200, the tool 200 may include a first side portion 206 and a second side portion 208 disposed opposite one another, as shown.

The tool 200 also may include an opening 210, which may be configured for interacting with a mating feature of the shooting rest 100 to selectively couple the tool 200 to the shooting rest 100, as described below, when the tool 200 is being stored. As shown, the opening 210 may be a through hole extending through the main body of the tool 200, from the front side to the back side thereof. In some instances, the opening 210 also may be used for receiving a lanyard for the tool 200 therethrough. The tool 200 may include a plurality of tool features 212 configured for use with one or more firearm accessories. In other words, the tool 200 may be a "multi-tool." As shown, the first end 202 may include one or more tool features 212, the second end 204 may include one or more tool features, the first side portion 206 may include one or more tool features, and the second side portion 208 may include one or more tool features. Various shapes and configurations of the tool features 212 may be used, including, for example, slotted screwdrivers, hex drivers, Torx drivers, spacers, and the like. In some examples, as shown, the tool 200 may include one or more indicia 214 for indicating one or more intended uses of the tool 200 to a user.

As shown, the shooting rest 100 may include a body 110 having a front end 112 and a rear end 114 disposed opposite one another. The body 110 may include a floor 120, a plurality of legs 130, 140, a plurality of walls 150, 152, a tool receptacle 160, and a pliable arm 180. As shown, the floor 120 may be formed as a generally planar structure having a top side and a bottom side disposed opposite one another. The plurality of legs 130, 140 may extend from the bottom side of the floor 120 and be configured for supporting the shooting rest 100 on a surface. In particular, the shooting rest 100 may include one or more front legs or supports 130 and one or more rear legs or supports 140. As shown, the shooting rest 100 may include a single front leg 130 having a generally U-shaped configuration formed by a front wall 132, a rear wall 134, and a base wall 136 thereof. The front leg 130 also may include an intermediate wall 138 extending from the floor 120 to the base wall 136 and from the front wall 132 to the rear wall 134, providing additional structural rigidity to the front leg 130. As shown, the shooting rest 100 may include a first rear leg 140*a* and a second rear leg 140*b* spaced apart from one another and each extending generally in the direction from the front end 112 toward the rear end 114 of the body 110. In some examples, as shown, the body 110 also may include a bridge 142 extending between and connecting the first rear leg 140*a* and the second rear leg 140*b*. Various configurations of the legs 130, 140 may be used in different examples.

The plurality of walls 150, 152 may extend from the top side of the floor 120 and define a magazine receptacle 156 configured for removably receiving a bottom portion of the firearm magazine FM therein. As shown, the body 110 may include a rear wall 150 and a pair of sidewalls 152. The rear wall 150 may be disposed at the rear end 114 of the body 110. As shown, a first sidewall 152*a* and a second sidewall 152*b* may be spaced apart from one another, and each of the sidewalls 152*a*, 152*b* may extend from the rear wall 150 along opposite edges of the floor 120. In this manner, the rear wall 150, the first sidewall 152*a*, and the second sidewall 152*b* collectively may define the magazine receptacle 156. In some instances, the body 110 also may include a front wall disposed at the front end 112 of the body, which also may define a portion of the magazine receptacle 156. In some examples, as shown, the rear wall 134 may extend above the sidewalls 152*a*, 152*b*, a first sloped portion 154*a* may be provided as a transition from the rear wall 150 to the first sidewall 152*a*, and a second sloped portion 154*b* may be provided as a transition from the rear wall 150 to the second sidewall 152*b*. Various shapes and configurations of the walls 150, 152 may be used in different examples.

The tool receptacle 160 may be disposed on one of the walls 150, 152 of the body 110 and configured for removably receiving at least a portion of the tool 200 therein. As shown, the tool receptacle 160 may be disposed on the rear wall 150. In particular, the tool receptacle 160 may be disposed on the outer surface of the rear wall 150 opposite the magazine receptacle 156. In some examples, the tool receptacle 160 may be disposed on one of the sidewalls 152*a*, 152 or on a front wall of the body 110. As shown, the tool receptacle 160 may include an open end 162 configured for allowing the tool 200 to be inserted into and removed from the tool receptacle 160, and a closed end 164 disposed opposite the open end 162 and configured for limiting insertion of the tool 200 into the tool receptacle 160 beyond the closed end 162. In some examples, the tool receptacle 160 may include a pair of rails 172 extending along opposite sides of the tool receptacle 160. As shown, the tool receptacle 160 may include a first rail 172*a* extending along a first side of the tool receptacle 160, and a second rail 172*b* extending along a second side of the tool receptacle 160 and spaced apart from the first rail 172*a*. The first rail 172*a* may define a first channel 174*a* configured for removably receiving the first side portion 206 of the tool 200, and the second rail 172*b* may define a second channel 174*b* configured for removably receiving the second side portion 208 of the tool 200. In some examples, as shown, the tool receptacle 160 may include a stop 166 disposed between the first rail 172*a* and the second rail 172*b* and defining the closed end 164 of the tool receptacle 160. The stop 166 may be shaped to complement one or more of the tool features 212 of the tool 200. Various shapes and configurations of the tool receptacle 160 may be used in different examples.

The pliable arm 180 may be disposed adjacent to the tool receptacle 160 and configured for releasably retaining the at least a portion of the tool 200 received within the tool receptacle 160. As shown, the pliable arm 180 may be formed as a resiliently deflectable spring arm having a fixed end 182 and a free end 184 disposed opposite one another. In some examples, as shown, the pliable arm 180 may be defined by a cutout 186 extending through the rear wall 150. The pliable arm 180 may be configured for being resiliently deflected from a first position, in which the pliable arm 180 retains the at least a portion of the tool 200 received within the tool receptacle 160, to a second position, in which the pliable arm 180 allows the at least a portion of the tool to be removed from the tool receptacle 160. As shown, the pliable arm 180 may include a protrusion 188 configured for engaging the opening 210 of the tool 200 when the pliable arm 180 is in the first position and the at least a portion of the tool 200 is received within the tool receptacle 160 and for disengaging the opening 210 when the pliable arm 180 is in the second position. As shown, the protrusion 188 may be formed as a raised cylindrical disc, although other shapes of the protrusion 188 may be used in other examples. In some examples, as shown, the protrusion 188 may include a beveled edge configured such that the pliable arm 180 is deflected from the first position toward the second position as the tool 200 is inserted into the tool receptacle 160. As shown, the protrusion 188 may be configured for being accessible through the opening 210 of the tool 200 when the pliable arm 180 is in the first position and the at least a portion of the tool 200 is received within the tool receptacle. In this manner, by depressing the protrusion 188, a user may deflect the pliable arm 180 from the first position toward the second position to allow for removal of the tool 200 from the tool receptacle 160, when desired. In some instances, a user may use an object, such as a firearm cartridge, to depress the protrusion 188 and deflect the pliable arm 180 in this manner. As shown, the body 110 may include indicia 192 indicating that a cartridge or another type of object may be used to facilitate removal of the tool 200 from the tool receptacle 160. Various shapes and configurations of the pliable arm 180 may be used in different examples.

Although specific examples of the disclosure have been described, numerous other modifications and alternative examples are within the scope of the disclosure. For example, any of the functionalities described with respect to a particular device or component may be performed by another device or component. Further, while specific device characteristics have been described, examples of the disclosure may relate to numerous other device characteristics. Further, although examples have been described in language specific to structural features and/or methodological acts, it is to be understood that the disclosure is not necessarily limited to the specific features or acts described. Rather, the specific features and acts are disclosed as illustrative forms of implementing the examples. Conditional language, such as, among others, "can," "could," "might," or "may," unless specifically stated otherwise, or otherwise understood within the context as used, is generally intended to convey that certain examples could include, while other examples may not include, certain features, elements, and/or steps. Thus, such conditional language is not generally intended to imply that features, elements, and/or steps are in any way required for one or more examples.

I claim:

1. A shooting rest for a firearm magazine, the shooting rest comprising:

a body having a front end and a rear end disposed opposite one another, the body comprising:

a floor having a top side and a bottom side disposed opposite one another;

a plurality of legs extending from the bottom side of the floor and configured for supporting the shooting rest on a surface;

a plurality of walls extending from the top side of the floor and defining a magazine receptacle configured for removably receiving a bottom portion of the firearm magazine therein;

a tool receptacle disposed on one of the plurality of walls and configured for removably receiving at least a portion of a tool therein; and a pliable arm disposed adjacent to the tool receptacle and configured for releasably retaining the at least a portion of the tool within the tool receptacle.

2. The shooting rest of claim 1, wherein the plurality of walls comprises a rear wall disposed at the rear end of the body, and wherein the tool receptacle is disposed on the rear wall.

3. The shooting rest of claim 2, wherein the tool receptacle is disposed on an outer surface of the rear wall opposite the magazine receptacle.

4. The shooting rest of claim 2, wherein the plurality of walls further comprises a first sidewall and a second sidewall spaced apart from one another and each extending from the rear wall.

5. The shooting rest of claim 1, wherein the tool receptacle comprises:

an open end configured for allowing the tool to be inserted into and removed from the tool receptacle; and a closed end disposed opposite the open end and configured for limiting insertion of the tool into the tool receptacle beyond the closed end.

6. The shooting rest of claim 5, wherein the tool receptacle further comprises:

a first rail extending along a first side of the tool receptacle, the first rail defining a first channel configured for removably receiving a first side portion of the tool; and a second rail extending along a second side of the tool receptacle and spaced apart from the first rail, the second rail defining a second channel configured for removably receiving a second side portion of the tool.

7. The shooting rest of claim 6, wherein the tool receptacle further comprises a stop disposed between the first rail and the second rail and defining the closed end of the tool receptacle, and wherein the stop is shaped to complement one or more tool features of the tool.

8. The shooting rest of claim 1, wherein the pliable arm is defined by a cutout extending through the one of the plurality of walls.

9. The shooting rest of claim 1, wherein the pliable arm is configured for being resiliently deflected from a first position, in which the pliable arm retains the at least a portion of the tool within the tool receptacle, to a second position, in which the pliable arm allows the at least a portion of the tool to be removed from the tool receptacle.

10. The shooting rest of claim 9, wherein the pliable arm comprises a protrusion configured for engaging an opening of the tool when the pliable arm is in the first position and the at least a portion of the tool is received within the tool receptacle and for disengaging the opening of the tool when the pliable arm is in the second position.

11. The shooting rest of claim 10, wherein the protrusion comprises a beveled edge configured such that the pliable arm is resiliently deflected from the first position toward the second position as the tool is inserted into the tool receptacle.

12. The shooting rest of claim 10, wherein the protrusion is configured for being accessible through the opening of the tool when the pliable arm is in the first position and the at least a portion of the tool is received within the tool receptacle.

13. A shooting rest for a firearm magazine, the shooting rest comprising:

a tool having a first end and a second end disposed opposite one another, the tool comprising a plurality of tool features; and a body having a front end and a rear end disposed opposite one another, the body comprising:

a floor having a top side and a bottom side disposed opposite one another;

a plurality of legs extending from the bottom side of the floor and configured for supporting the shooting rest on a surface;

a plurality of walls extending from the top side of the floor and defining a magazine receptacle configured for removably receiving a bottom portion of the firearm magazine therein;

a tool receptacle disposed on one of the plurality of walls and configured for removably receiving at least a portion of the tool therein; and a pliable arm disposed adjacent to the tool receptacle and configured for releasably retaining the at least a portion of the tool within the tool receptacle.

14. The shooting rest of claim 13, wherein the plurality of walls comprises a rear wall disposed at the rear end of the body, and wherein the tool receptacle is disposed on an outer surface of the rear wall opposite the magazine receptacle.

15. The shooting rest of claim 13, wherein the tool further comprises a first side portion and a second side portion disposed opposite one another, and wherein the tool receptacle comprises:

an open end configured for allowing the tool to be inserted into and removed from the tool receptacle;

a closed end disposed opposite the open end and configured for limiting insertion of the tool into the tool receptacle beyond the closed end;

a first rail extending along a first side of the tool receptacle, the first rail defining a first channel configured for removably receiving the first side portion of the tool;

a second rail extending along a second side of the tool receptacle and spaced apart from the first rail, the second rail defining a second channel configured for removably receiving the second side portion of the tool; and a stop disposed between the first rail and the second rail and defining the closed end of the tool receptacle, and wherein the stop is shaped to complement one or more of the tool features of the tool.

16. The shooting rest of claim 13, wherein the tool further comprises an opening, wherein the pliable arm is configured for being resiliently deflected from a first position, in which the pliable arm retains the at least a portion of the tool within the tool receptacle, to a second position, in which the pliable arm allows the at least a portion of the tool to be removed from the tool receptacle, and wherein the pliable arm comprises a protrusion configured for engaging the opening of the tool when the pliable arm is in the first position and the at least a portion of the tool is received within the tool receptacle and for disengaging the opening of the tool when the pliable arm is in the second position.

* * * * *